US005590811A

United States Patent [19]

Hill

[11] Patent Number: 5,590,811

[45] Date of Patent: Jan. 7, 1997

[54] CRAYON ORGANIZER

[76] Inventor: David Hill, c/o Dorlena Engfer 236 Mockingbird Rd., Box Elder, S. Dak. 57706

[21] Appl. No.: 530,942

[22] Filed: Sep. 20, 1995

[51] Int. Cl.[6] ..... B65D 83/00

[52] U.S. Cl. ..... 221/89; 221/66; 221/91; 312/73

[58] Field of Search ..... 221/66, 89, 91, 221/121, 122, 154, 76; 312/72, 73, 97.1

[56] References Cited

U.S. PATENT DOCUMENTS

| | | | |
|---|---|---|---|
| 1,333,695 | 3/1920 | Anshelm | 312/73 |
| 3,605,435 | 9/1971 | Taylor | 221/89 |
| 4,136,773 | 1/1979 | Booth | 206/214 |
| 4,150,766 | 4/1979 | Westendorf et al. | 221/112 |
| 5,002,182 | 3/1991 | McGinnis | 206/214 |
| 5,069,361 | 12/1991 | Jeffway, Jr. et al. | 221/82 |

FOREIGN PATENT DOCUMENTS

| | | | |
|---|---|---|---|
| 2073706 | 10/1981 | United Kingdom | 221/91 |

*Primary Examiner*—H. Grant Skaggs
*Attorney, Agent, or Firm*—Gene R. Woodle

[57] ABSTRACT

Embodiments of a crayon organizer are disclosed which may be used to store, organize, and dispense crayons, chalks, or similar articles. The crayon organizer has a cylindrical cover with an open slot through which one crayon, chalk, or similar article may be removed at a time from the organizer. The crayons, chalks, or similar articles are placed inside vertical holes in a base which fits inside the cover. The crayon organizer has a lock out mechanism which prevents another crayon, chalk, or similar item from being withdrawn from the organizer until the first one removed is returned.

2 Claims, 2 Drawing Sheets

CRAYON ORGANIZER

BACKGROUND OF THE INVENTION

1. Field of the Invention

The present invention relates generally to containers for crayons, chalks, and similar articles; and more particularly to such a container which promotes and provides for the care and organization of crayons, chalks, and similar articles.

2. Background Information

The invention presented in the present application is believed to solve, in a simple and effective fashion, a problem which has long plagued parents, teachers, children, and others who have dealt with the disorganization and loss associated with the use of crayons, chalks, and similar articles by children: a method of organizing and dispensing crayons in a manner which teaches children to be responsible in their crayon use.

Crayons, chalks, and similar articles are used on a nearly daily basis by vast numbers of children. Parents, teachers, and other guardians of these children are all very familiar with problems associated with such use. Crayons, chalks, and similar articles are subject to being scattered, lost, and broken.

Several attempts have been made to at least partially solve problems relating to the use of crayons, chalks, and similar articles by children in homes, schools, and day care centers.

One such attempt is disclosed in the patent to Jeffway, Jr. et al. (U.S. Pat. No. 5,069,361, Dec. 3, 1991) which discloses a crayon caddie consisting of a rotatable, horizontal cylinder with slots around the circumference to hold crayons or similar objects. This cylinder is enclosed in a case which has a hopper on the top. Crayons may be placed in the hopper and fall into individual slots on the cylinder as the cylinder is rotated. The cover also features a transparent window on one side through which crayons may be seen and a crayon dispenser. The dispenser has a gate which may be opened when a particular crayon is opposite the dispenser and the crayon falls into a dispenser tray.

Another attempt to solve problems relating to the use of crayons, chalks, or similar articles is disclosed in the patent to McGinnis (U.S. Pat. No 5,002,182, Mar. 26, 1991) which discloses a combined crayon holder and container. The container is a cylindrical box with a removable top. When the top is opened crayons may be placed in the container. Individual crayon holders are provided which have "fingers" which grip the crayon within the holder. As the crayon becomes shorter with use the crayon may be pushed with a supplied rod so that more of the crayon is exposed and is, again, held in place by the "fingers" so that even very short crayons may be used.

The ideal crayon organizer provides a device for the efficient storage, organization, and dispensing of crayons, chalks, and similar articles in a manner which encourages children to use such items responsibly. The ideal crayon organizer should also be simple, lightweight, durable, compact, and inexpensive.

SUMMARY OF THE INVENTION

The crayon organizer of the instant invention solves problems relating to the use of crayons, chalks, and similar articles by providing a device for organizing, storing, and dispensing such articles in a manner which promotes responsible use of such articles. The present invention provides a crayon organizer consisting of a vertical, rotating, cylindrical cover which is attached to a base. The base includes a plurality of vertical, cylindrical holes slightly larger than a conventional crayon and crayons or similar items may be placed in these holes. The top, outside edge of the cover includes a slot through which one crayon at a time and only one crayon may be accessed and pulled from the cylindrical holes in the base. One of the unique features of the present invention is a lock out system which prevents more than one crayon from being taken from the organizer at a time. That is, a crayon in use must be replaced before another crayon may be taken from the organizer.

One of the major objects of the present invention is to provide a device for the efficient storage, organization, and dispensing of crayons, chalks, and similar articles.

Another objective of the present invention is to provide a device which teaches and promotes the responsible use of crayons, chalks, and similar articles.

Another objective of the present invention is to provide a crayon organizer which is simple, lightweight, durable, compact, and inexpensive.

These and other features of the invention will become apparent when taken in consideration with the following detailed description and the drawings.

DESCRIPTION OF A PREFERRED EMBODIMENTS

Figure 1:
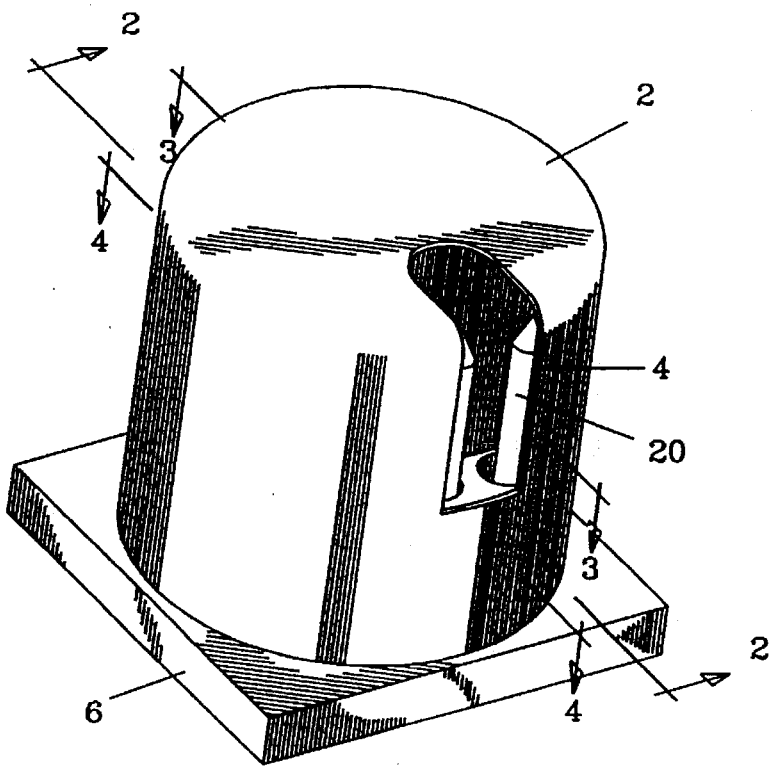
FIG. 1 is a perspective view of a preferred form of a crayon organizer of the present invention.

Referring to the drawings, FIGS. 1, 2, 3, 4, and 5, there is shown a preferred form of the crayon organizer embodying the present invention.

Referring to FIG. 1, there is a cover 2 having the general shape of a hollow cylinder with a closed top and an open bottom. There is a slot 4 which is an opening in the upper, outside quadrant of the cover 2. Said cover 2 is rotatably attached to a base 6.

Figure 2:
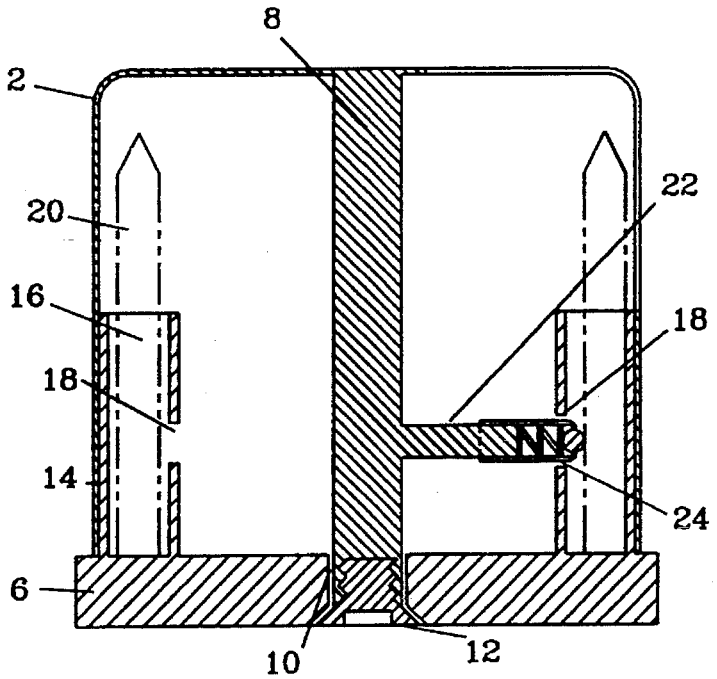
FIG. 2 is a sectional view of the crayon organizer taken along line 2—2 of FIG. 1.

Referring now to FIG. 2, there is a post 8 attached to the inside of the top of said cover 2 at the center of the top of said cover 2 such that the post 8 follows the longitudinal axis of said cover 2. There is a vertical hole 10 in the center of the base 6 and said post 8 is of sufficient length to fit into the hole 10. Said hole 10 is countersunk at its lower end such that the bottom of said hole 10 has the general shape of a truncated cone with the base of the cone at the bottom. The bottom of said post 8 is interiorly screw threaded and a screw 12 is screwed into those threads. The top of screw 12 fits within the countersunk portion of said hole 10 and is larger than the smaller, upper portion of said hole 10. Said screw 12 thus fastens said cover 2 to said base 6 while allowing said cover 2 to rotate about said post 8.

Still referring to FIG. 2, said base 6 includes a holder 14. The holder 14 has the general shape of a thick-walled, hollow cylinder having the same longitudinal axis as said cover 2 and protruding upward from said base 6 into the interior of said cover 2. The height of said holder 14 is such that the top of said holder 14 is slightly lower than the bottom of said slot 4. The outer diameter of said holder 14 is slightly less than the inner diameter of said cover 2. The wall thickness of said holder 14 is slightly larger than the diameter of a conventional crayon.

Figure 3:
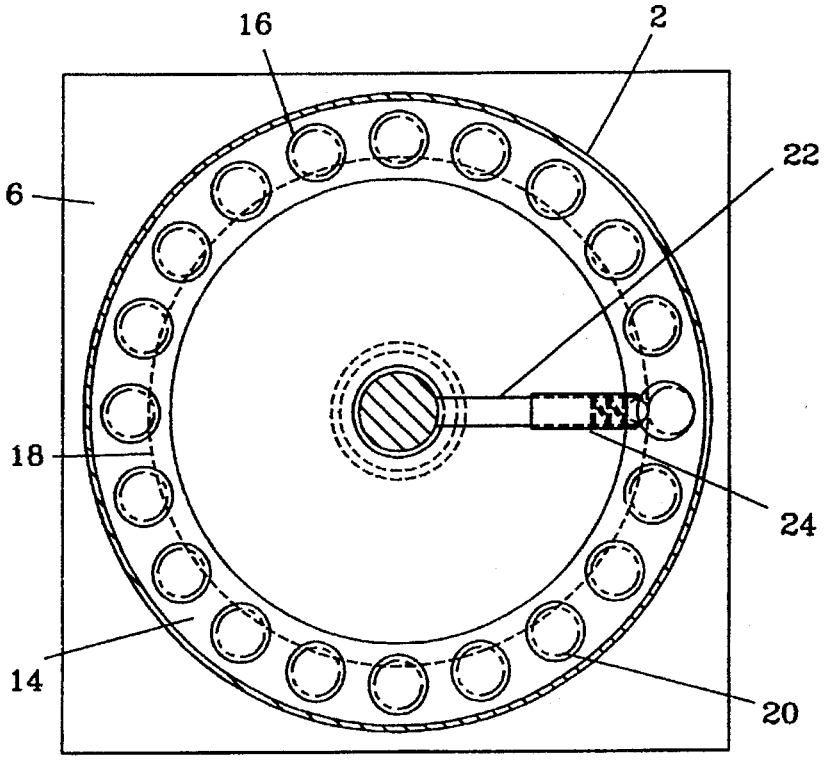
FIG. 3 is a sectional view of the crayon organizer taken along line 3—3 of FIG. 1.

Referring now to FIG. 3, there is a plurality of vertical holes 16 through the wall of said holder 14 equally spaced around the circumference of said holder 14. The holes 14 are spaced equidistant from the inner and outer surfaces of said holder 14 and are open at the top and closed at the bottom. Said holes 16 have a diameter slightly larger than the diameter of a conventional crayon and slightly smaller than the wall thickness of said holder 14. There is a circular ring 18 cut into the inside surface of said holder 14. The ring 18 is of sufficient depth and width that the interior of said holes 16 is open through said ring 18 to the interior of said holder 14.

Referring again to FIG. 1, conventional crayons 20 may be placed through said slot 4 into said holes 16.

Referring again to FIG. 2, there is an arm 22 extending outward from said post 8 at the level of said ring 18. A collar 24 fits over the arm 22 and is slideable upon said arm 22. Said arm 22 is aligned with said slot 4.

Figure 4:
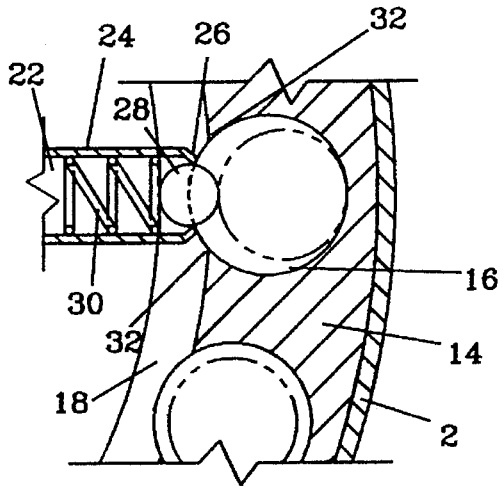
FIG. 4 is an enlarged, partial, sectional view of the crayon organizer taken along line 4—4 of FIG. 1.

Referring now to FIG. 4, the outer end of the collar 24 has a crimp 26. There is a ball 28 within said collar 24 at its outer end held in place by the crimp 26. There is a spring 30 inside said collar 24 which abuts and is attached to the outer end of said arm 22 at one end and abuts and pushes against the ball 28 at its other end. The end of spring 30 opposite said arm 22 is attached to said collar 24. Said spring 30 tends to force said collar 24 and said ball 28 outward. If a crayon 20 is inside said hole 16 aligned with said slot 4, the outermost surface of said ball 28 touches said crayon 20. Said spring 30 is compacted and said collar 24 slides inward on said arm 22. If said cover 2 is rotated said ball 28 revolves and rolls over a lip 32 and along said ring 18. Thus, a different hole 16 and a different crayon 20 becomes accessible through said slot 4.

Figure 5:
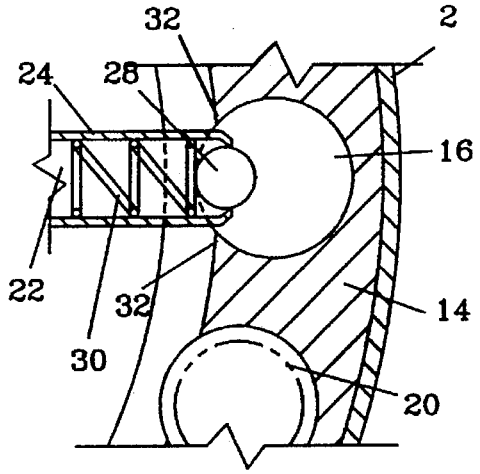
FIG. 5 is an enlarged, partial, sectional view of the crayon organizer showing the same view as FIG. 4; but showing an alternate position of certain elements.

Referring now to FIG. 5 which shows the same view as FIG. 4 with said crayon 20 opposite said arm 22 removed; with said crayon 20 removed, said spring 30 pushes said collar 24 and said ball 28 into said hole 16 aligned with said slot 4. Said collar 24 is pushed sufficiently far into said hole 16 that the outer edge of said collar 24 hits lip 32 if said cover 2 if rotated. This prevents said cover 2 from being rotated and only the empty hole 16 aligned with said slot 4 is accessible through said slot 4. Said spring 30 is of sufficient length that said collar 24 prevents rotation of said cover 2 when said hole 16 aligned with said slot 4 is empty; but to prevent said collar 24 and said ball 28 from protruding so far into said hole 16 that a crayon 20 can not be pushed into said hole 16 through said slot 4.

In operation a plurality of crayons 20 equal to the number of said holes 16 may be placed in said holes 16 though said slot 4 by placing a crayon 20 in said hole 16 aligned with said slot 4 and rotating said cover 2 to expose an empty hole 16. After each of said holes 16 are loaded with a crayon 20, said cover 2 may be rotated to expose the crayon 20 selected for use. Said ball 28 rolls over the inner surface of the crayons 20 and within said ring 18. After a crayon 20 is selected and withdrawn through said slot 4, said collar 24 protrudes into the empty hole 16 and prevents said cover 2 from being rotated and another crayon 20 from being selected. That is, once a crayon 20 is selected and removed from the crayon organizer, another crayon 20 may not be removed until the first is returned.

In the preferred embodiment of the crayon organizer all pieces with the exception of said spring 30 are made from tough, durable plastic which is non-toxic; but other materials such as steel or aluminum could be used. In the preferred embodiment said cover 2 is transparent to facilitate selection of a particular crayon 20. In the preferred embodiment said spring 30 is a conventional coil spring, but other resilient means could be used.

While preferred embodiments of this invention have been shown and described above, it will be apparent to those skilled in the art that various modifications may be made in these embodiments without departing from the spirit of the present invention. For that reason, the scope of the invention is set forth in the following claims:

I claim:

1. A crayon organizer comprising:

(1) a cover having the general shape of a hollow cylinder, and the cover having a covered top and an open bottom and having a slot in its upper, outside quadrant which is an opening just large enough to allow access to the interior of said cover with the thumb and forefinger;

(2) a base slightly larger than said cover;

(3) a post aligned with the longitudinal axis of said cover and attached to the inner surface of the top of said cover at the center of the top; and the bottom of the post being rotatably attached to the base such that the bottom of said cover touches or nearly touches the top of said base and said cover may be rotated about said post; and (4) a holder having the general shape of a thick-walled, hollow cylinder, the holder being slightly smaller than the inside of said cover and being aligned with said cover; the bottom of said holder being attached to the top of said base; said holder being of sufficient height that the top of said holder reaches a point slightly below the lowest portion of the slot in said cover; and said holder containing a plurality of vertical holes within its wall which are open at the top and closed at the bottom and the same height as the height of said holder;

whereby crayons, chalks, or similar articles may be place through said slot in said cover and into the holes in said holder; and said cover rotated about said post thereby allowing access to individual crayons, chalks, or similar articles through said slot; and one and only one crayon, chalk, or similar article may be removed from the crayon organizer at a time.

2. A crayon organizer of claim 1 having lock out means to prevent said cover from being rotated about said post unless a crayon, chalk, or similar article is placed within the hole in said holder which is aligned with and accessible through said slot in said cover.

* * * * *